United States Patent [19]

Foreman

[11] 4,033,585

[45] July 5, 1977

[54] AMUSEMENT GAME

[76] Inventor: Larry W. Foreman, 115 W. Burnette Ave., Enfield, N.C. 27823

[22] Filed: Oct. 8, 1975

[21] Appl. No.: 620,636

[52] U.S. Cl. ..... 273/120 R; 273/118 R; 273/119 R

[51] Int. Cl.[2] ..... A63F 7/02; A63F 7/10

[58] Field of Search ..... 273/86 R, 86 B, 86 C, 273/86 D, 101, 108, 118–127

[56] References Cited

UNITED STATES PATENTS

| | | | |
|---|---|---|---|
| 1,682,645 | 8/1928 | Vollmer | 273/119 R |
| 1,811,812 | 6/1931 | Uber | 273/86 B X |
| 1,943,697 | 1/1934 | Schultz | 273/123 R |
| 2,349,040 | 5/1944 | Grant | 273/108 |
| 2,441,641 | 5/1948 | McAleer | 273/108 |
| 2,597,671 | 5/1952 | Prentiss | 273/108 |
| 2,815,213 | 12/1957 | Wisener | 273/118 R |
| 3,612,531 | 10/1971 | Barlow | 273/101 |

FOREIGN PATENTS OR APPLICATIONS

| | | | |
|---|---|---|---|
| 14,310 | 6/1926 | Netherlands | 273/119 R |

*Primary Examiner*—Richard J. Apley
*Attorney, Agent, or Firm*—Mills & Coats

[57] ABSTRACT

The present invention relates to a game and gameboard apparatus wherein the game is played by directing a marble or similar projectile across a gameboard in a generally straight line path and wherein one or more players stationed along the gameboard attempt to strike and intercept the marble (target projectile) as the same moves across the playing board. To provide for the opportunity of interception, the gameboard of the preferred embodiment comprises a series of longitudinally spaced shooting or intercepting stations with a respective player stationed at each station. In a typical type of game, the respective players stationed along the gameboard attempt to intercept a passing target projectile as the same moves along a normal straight line course across the board. Although various ways are disclosed for intercepting the target projectile, the main principle of interception revolves around a respective player actuating an intercepting projectile, pendulum member, or the like such that the same crosses the path of the target projectile at an area point at the same time the target projectile is passng through the same area point. This results in a hit and accordingly the target projectile is intercepted and a score or point is given to the player or the player's team making the hit or interception.

8 Claims, 6 Drawing Figures

AMUSEMENT GAME

The present invention relates to a game or amusement device, and more particularly to a projectile type game or amusement device wherein the main object of the game is to intercept or hit a target projectile while in movement with another projectile or intercepting member in which the target projectile is moving across a gameboard.

BACKGROUND OF THE INVENTION

Children, as well as adults, both young and old, have always enjoyed games or amusement devices that entail action and excitement, require skill, and can be played by individual against individual or team against team. More particularly, games or amusement devices that center around moving elements where contact of one moving element with another forms a principal object of the game and wherein respective players actually control at least some of the moving elements have always been especially popular among game enthusiasts.

In the present invention, a game or amusement device is provided where the principal object of the game as played with the game device and apparatus of the present invention revolves around intercepting or striking a moving projectile passing over a gameboard by the use of another projectile (sometimes referred to as the intercepting projectile) or other appropriate movable members. In particularly, the game of the present invention provides a generally rectangular gameboard that includes a series of shooting stations disposed therearound. An incline chute is disposed about one end of the gameboard and extends upwardly therefrom in an incline fashion, with the remote end being supported at a height above the level of the gameboard. In playing the game, target projectiles are deposited in the chute one at a time and under the influence of gravity the target projectiles, which are preferably marble-like elements, roll down the chute and onto the gameboard and thereacross in a generally straight line. The game or amusement device is provided with means about the respective shooting stations that are actuated and controlled by respective players for attempting to strike or intercept the target projectile as the same moves across the playing board in a normal straight line of travel resulting from the momentum of the marble-like target projectile exiting from the chute onto the gameboard. Although various types of means is disclosed for intercepting the target projectile passing across the playing board, again the main object is for each respective player to attempt to strike or intercept the target projectile as it passes across the playing board across from the respective shooting station.

It is, therefore, an object of the present invention to provide a projectile intercepting game or amusement device where the object of the game centers around intercepting a target projectile moving acorss a gameboard with another projectile or intercepting member.

A further object of the present invention is to provide a game or amusement device that requires skill to proficiently play the game and which is adapted to allow individual competition against individual as well as team competition.

Still a further object of the present invention is to provide a game or amusement device in which projectiles are propelled across a gameboard with the basic object being to intercept a target projectile, but where the gameboard and accessories are constructed to provide a safe and sturdy gameboard and game apparatus.

A further object of the present invention is to provide a game or amusement device comprising a gameboard, a series of shooting stations, and an elevated inclined target projectile chute for receiving target projectiles one at a time and directing the same downwardly thereon onto said gameboard where the same target projectiles move therealong in a generally straight path, and wherein a plurality of respective players each stationed at a respective shooting station attempt to intercept the moving projectile by actuating intercepting means that move across the path of the target projectile as it passes the respective shooter stations.

Another object of the present invention is to provide a projectile intercepting game or amusement device in which the gameboard and game accessories are relatively inexpensive, but sturdy and reliable and in which the game to be played therewith is simple to understand and appreciate and can be played by children and young adults of a wide age range.

Other objects and advantages of the present invention will become apparent from a study of the following description and the accompanying drawings which are merely illustrative of the present invention.

BRIEF DESCRIPTION OF THE DRAWINGS

With further reference to the drawings, particularly FIGS. 1 through 3, the game or game apparatus of the present invention is shown therein and indicated generally by the numberal 10. Viewing the game apparatus 10 in greater detail, it is seen that the same comprises a generally rectangular gameboard 12 having a generally flat top playing surface. Gameboard 12 (which may be constructed of plastic, wood, or other suitable material) further includes a slightly raised border 14 that tends to retain the projectiles or marbles about the top playing surface of the gameboard during play. As illustrated in FIG. 2, gameboard 12 is supported above the level of a floor or other supporting surface such as a table by a series of corner leg supports 16 and a pair of intermediate side legs supports 18, all of the supports being secured to the gameboard 12 and depending downwardly therefrom where they rest against the supporting structure.

Figure 1:
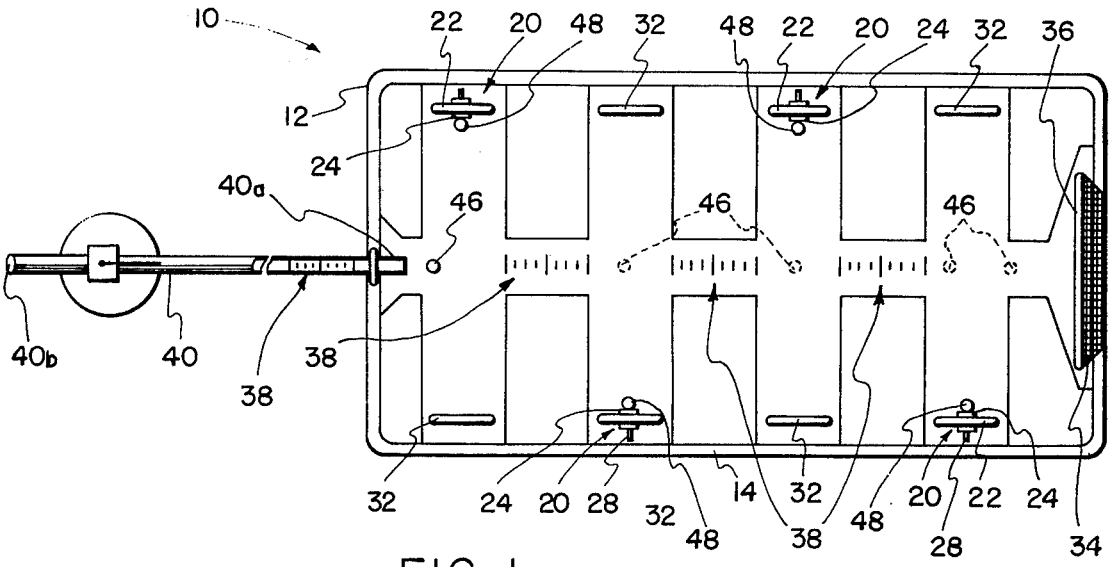
FIG. 1 is a top plan view of the game apparatus of the present invention.

Disposed about the gameboard 12 are a series of shooting stations, each shooting station being indicated generally by the numeral 20. In the embodiment illustrated in FIGS. 1 through 3, the shooting stations are disposed along opposite sides of the gameboard 12 and are longitudinally staggered with respect to a center line that would extend from left to right centrally along the gameboard 12 as viewed in FIG. 1. In the case of the embodiment illustrated in FIGS. 1 through 3, each shooting station 20 includes a generally inverted U-shaped shooter frame 22 that is secured to the top of the gameboard 12 and extends upwardly therefrom. Disposed between the outer legs of each shooter frame is a plunger 24 that is generally held in a position between the legs of the shooter frame 22 by resilient means 26 such as rubber bands or the like, the rubber bands being fixed to the plunger and to the shooter frame 22. In addition, about the outer side of the plunger 24 there is provided a handle 28 that enables the plunger 24 to be pulled to a retracted position. Therefore, it is appreciated that the plunger 24 may be used to propel an intercepting projectile 48, preferably in the form of a marble, by placing the intercepting projectile 48 adjacent the inner side of the plunger, as viewed in FIG. 1, and pulling the handle 28 such that the plunger is pulled to a retracted position. After being pulled to the retracted position, a particular player stationed at that respective shooting station may selectively release the handle 28, causing the plunger under the influence of the resilient means or rubber bands 26 to move back to its normal rest position. Consequently, as the plunger moves back to its normal rest position, it strikes the waiting intercepting projectile or marble 48 and strikes the same causing the marble to be propelled transversely across the playing gameboard 12.

Figure 2:
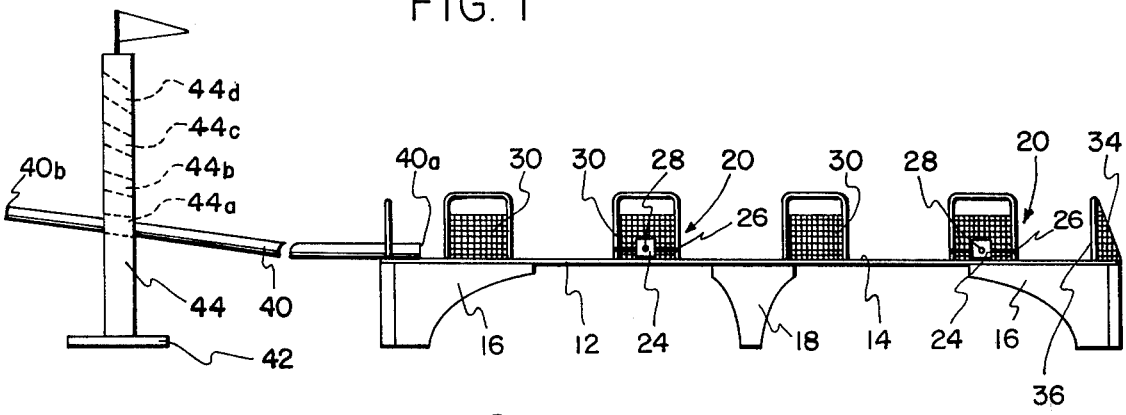
FIG. 2 is a side elevational view of the game apparatus of the present invention.
Figure 3:
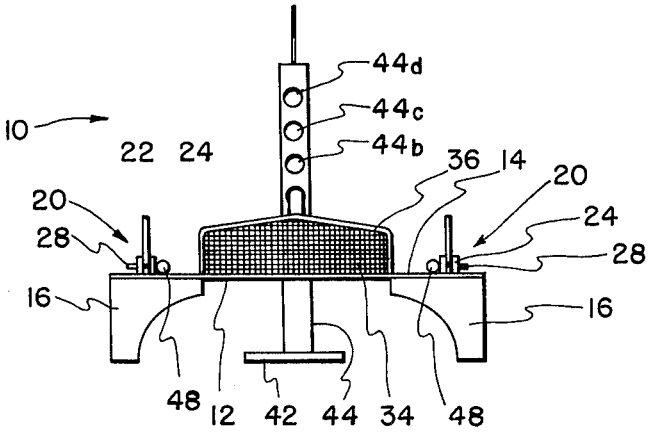
FIG. 3 is an end elevational view of the game apparatus of the present invention as illustrated in FIGS. 1 and 2.

Disposed opposite each shooting station is a type of retaining means and in the case of the present invention, the retaining means is in the form of a series of side nets 30 that are supported within respective side net frames 32, each side net being stationed along a side of the game board 12 directly opposite the shooting station 20 or as in the case of FIGS. 1 through 3, directly opposite the plunger 24. Consequently, a plunger propelled marble projectile may be retained by a respective side net 30.

In addition, disposed on one end of the gameboard 12 is an end retaining net 34 that is supported by an end net retaining frame 36. As will become more fully understood and appreciated in subsequent portions of the present disclosure, the end net 34 serves to catch or retain various target projectiles that move longitudinally across the gameboard, from left to right, as viewed in FIG. 1, during the course of the game being played.

Disposed about the end of the gameboard 12 opposite the end net 34 is a chute 40 that is inclined at an angle relative to the horizontal plane of the gameboard 12. More particularly, the chute 40 includes an exiting end 40*a* that is generally supported about an end portion of the gameboard generally midway between the respective sides thereof, as illutrated in FIG. 1. In addition, the chute 40 includes a remote end 40*b* that is generally disposed at a height above the general level of the gameboard 12 and is supported thereby by a stand that includes a base 42 and an upright post 44 that is secured to the base 42 and extends generally upwardly therefrom. Provided in the upright post 44 are a series of vertically spaced openings, 44*a*, 44*b*, 44*c* and 44*d*, that allow the chute 40 to be positioned at various inclined angles with respect to the gameboard 12.

Chute 40 is adapted to receive in the remote end 40*b* thereof target projectiles 46 that are preferably in the form of marbles. In playing the game of the present invention, a single target projectile 46 is deposited in the remote end 40*b* of the chute 40 and allowed to roll down towards the gameboard 12 under the influence of gravity. As illustrated in FIG. 1, once the target projectile 46 exits the chute 40, the same tends to move in a straight line from the left end of the gameboard 12 towards the end net 34 as viewed in FIG. 1. Therefore, it is seen that when properly disposed that each target projectile 46 deposited in the remote end 40*b* of the chute, will exit therefrom and move across the gameboard in a generally normal straight line path.

The principal object of the several games that can be played with such a game apparatus, is to intercept the target projectile 46 as it moves along its normal straight line path from the exiting end 40*a* of the chute 40 towards the end net 34. In the case of the embodiment illustrated in FIGS. 1 through 3, the respective players stationed at the shooting stations 20 are appraised by the individual depositing the target projectile 46 into the remote end 40*b* of the chute and as the target projectile 46 moves across the gameboard, the respective players pull their respective plungers 24 to a retracted position, and at a selected time release the plunger causing the intercepting projectile 48 to be propelled across the gameboard and across the path of the target projectile 46 with the objective being to hit or intercept the target projectile.

To improve a player's timing and proficiency in the game, there is provided a series of hash marks indicated generally by the numeral 38 along the normal path of travel of the target projectile. Consequently, a particular player can judge the time of releasing the plunger (or other type member) in accordance with the position of the target projectile 46 along the preceding set of hash marks 38.

Figure 4:
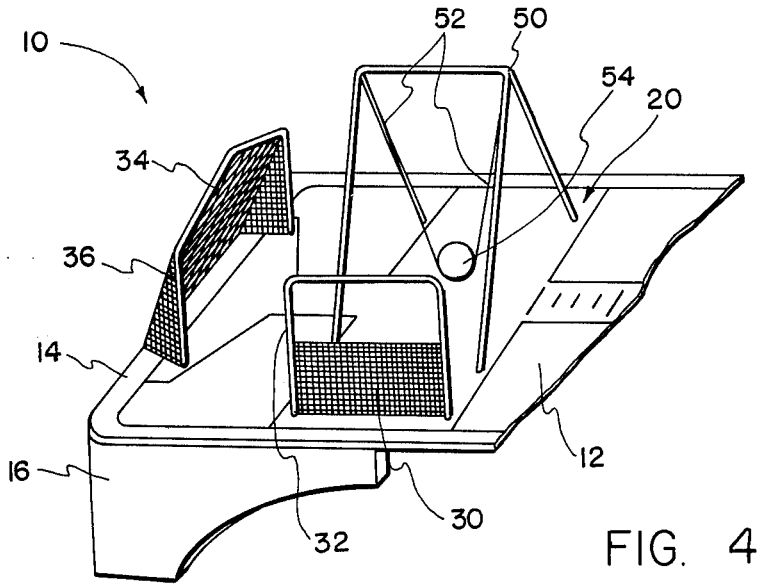
FIG. 4 is a fragmentary perspective view of the game board of the game apparatus of the present invention, particularly illustrating a pendulum type target projectile intercepting structure that may be used with the game apparatus of the present invention.

Turning to FIG. 4, there is shown therein an alternate device for intercepting the target projectile 46. Here there is provided a pendulum structure that is actuated by a player with the pendulum structure including an A-frame support 50 that is disposed over the normal path of travel of the target projectile and includes a pair of swing arms 52, constructed of string or rigid material, the swing arms being connected to a pendulum member 54 that is adapted to be swung back and forth across the path of the target projectile as it moves through the A-frame support structure 50. Consequently in this alternate design, the respective player pulls the pendulum member 54 back to a retracted position and releases the same as the target projectile 46 begins to move towards and under that particular A-frame support structure. The object once again being to hit or intercept the target projectile 46 passing therethrough.

Figure 5:
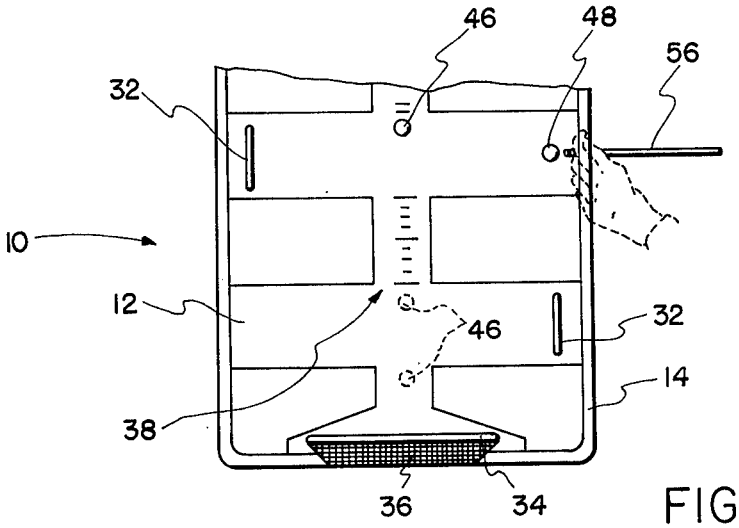
FIG. 5 is another fragmentary perspective view of the gameboard of the present invention, particularly illustrating the use of a cue stick to initiate movement of an intercepting projectile intended to intercept a rolling target projectile passing across the gameboard.
Figure 6:
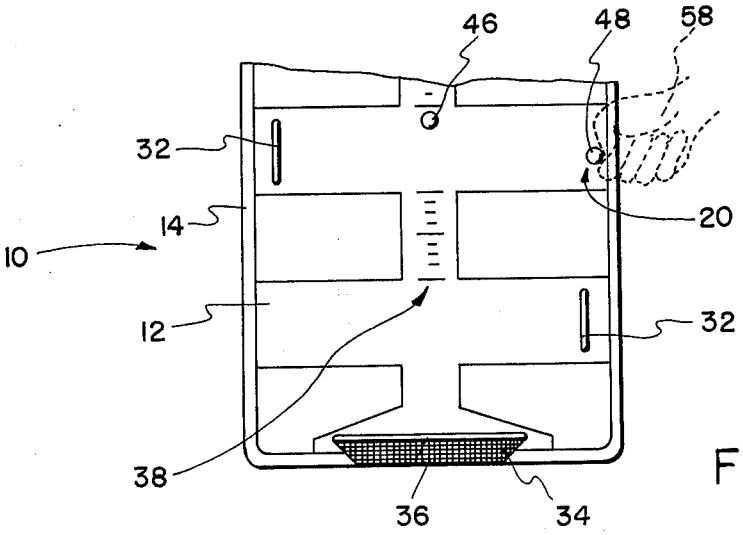
FIG. 6 is another fragmentary elevational view of a portion of the gameboard illustrating the use of a player's thumb to initiate and propel an intercepting projectile across the gameboard with the object again being to intercept a rolling target projectile.

In FIG. 5, another alternate way is shown in which to propel the intercepting projectile 48 across the playing board 12. In this case, there is provided a cue stick 56 and the player strikes the intercepting projectile 48 at a desired time and directs the same across the playing board 12 generally transverse with respect to the normal path of the target projectile 46 with the intent of striking or intercepting the same. Finally, with respect to FIG. 6, the same intercepting projectile 48, again preferably in the form of a marble, is shown being propelled by the thumb of a player's hand 58, as is done in conventional marble playing.

The game apparatus 10 of the present invention may be used in a variety of ways to play numerous games. In the way of explanation, the individual who deposits the target projectile or marbles 46 into the chute 40 will be referred to as the "roller," while the players stationed along side the gameboard 12 will be referred to as "shooters." Because of the staggered and longitudinal spaced relationship of the shooting stations, it is contemplated that in any type of game the individual players to be shooters will draw for particular positions about the board.

In the way of examples, one game may be played by a group of shooters stationed around the gameboard 12 and with one roller to deposit the target projectile 46 into the chute. In this game, the roller simply drops a target projectile or marble 46 into the chute 40 and allows the same to roll across the board as illustrated in FIG. 1. As the target projectile moves from left to right, as viewed in FIG. 1, across the gameboard 12, each individual shooter tries to hit or intercept the target projectile 46 in any one of the ways discussed hereinbefore. The first shooter to make a predetermined number of hits or interceptions wins the games. The number of hits or interceptions can be set at 21, 11, 6 or any number decided on by the group playing.

Another type of game that can be played with the game apparatus 10 of the present invention is a game where the roller plays against all of the shooters. In this game, the shooters may still want to draw for positions about the gameboard, but the object is for the shooters to intercept the target projectile 46 before it reaches the end screen 34. A point is scored by the shooters by making an interception, while a point is scored by the roller upon a particular target projectile 46 moving across the board without being intercepted by any of the shooters. In this game, the first (the roller or shooters) who score a predetermined number of points wins the games. Also, it should be appreciated that games along the line of baseball or bowling can be played, and in fact, the above referred to games can be played with partners or on a team basis. In the case of playing a game on a team basis, it is contemplated that the individuals playing the game will draw to determine team members and positions about said gameboard 12.

From the foregoing, it is clear that the game apparatus 10 of the present invention presents an amusement device that entails a great deal of action and excitement, while requiring skill on the part of the players to play the various games proficiently. Also, the game apparatus 10 of the present invention is susceptible to being used for a wide number of games in which an individual may play against an individual, or the competition can be based on teams.

The terms "upper," "lower," "forward," "rearward," etc., have been used herein merely for the convenience of the foregoing specification and in the appended Claims to describe the amusement game and its parts as oriented in the drawings. It is to be understood, however, that these terms are in no way limiting to the invention since the amusement game may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. An amusement game comprising: a gameboard having a generally flat plane surface; means for directing a rolling target projectile across said gameboard such that said target projectile moves across said gameboard in a generally straight line path when not interfered with; a plurality of shooting stations disposed on said gameboard playing surface in longitudinal spaced apart relationship relative to the normal straight line path of said target projectile and with each shooting station spaced laterally from said normal straight line path of said target projectile, wherein during play respective players at each shooting station are provided with intercepting rolling projectiles that are propelled by the respective players across said playing board and towards the normal straight line path of said target projectile while the same moves across said playing board with the object being to hit or intercept the target projectile with the intercepting projectile whose movement across said playing board is initiated by a respective player; and retaining means formed on said gameboard about said playing surface to retain said target and intercepting projectile thereon and to prevent the same from generally rolling off said playing surface.

2. The amusement game of claim 1 wherein said target and intercepting projectiles are in the form of marble-like rolling elements.

3. The amusement game of claim 2 wherein said means for directing a rolling target projectile across said gameboard includes an elongated chute disposed adjacent said gameboard and adapted to receive respective marble-like elements therein, said chute having an exiting end positioned such that respective marble-like elements passing therefrom move onto said gameboard and move thereacross and wherein said chute is inclined at an angle relative to said gameboard such that the chute is inclined generally upwardly from said gameboard such that a marble-like element deposited in said chute at a position remote from said exiting end tends to move down said chute towards said gameboard under the influence of gravity.

4. The amusement game of claim 3 wherein the same is provided with an adjustable height stand for receiving and supporting said chute at a position remotedly from said gameboard.

5. The amusement game of claim 4 wherein said game is provided with a series of hash marks along a generally straight line across said gameboard, said hash marks being provided for about the normal straight line path of travel of said target projectiles exiting from said chute and moving across said gameboard, whereby the respective players may use said hash marks to assist them in timing the initiating of movement of said intercepting projectiles while playing the game.

6. The amusement game of claim 5 wherein said retaining means includes a net retaining structure opposite each shooting station along one side of said gameboard, and about an end portion of said gameboard opposite the exiting end of said chute.

7. The amusement game of claim 1 wherein each of said shooting stations are provided with a plunger-like shooter, and biasing means secured to said plunger-like shooter for actuating the same in response to said plunger-like shooter being pulled to a retracted position and released, whereby said plunger-like shooter may be used to strike and propel the respective intercepting projectiles across said gameboard with the object being to strike or intercept a target projectile passing thereacross.

8. The amusement game of claim 1 wherein the game is provided with a plurality of cue sticks, wherein respective players stationed at said shooting stations are provided with a cue stick that may be used to strike and actuate an intercepting projectile so as to initiate the movement of said intercepting projectile across said gameboard with the object being to strike or intercept the moving target projectile.

* * * * *